United States Patent [19]

Moingeon et al.

[11] Patent Number: 4,824,532

[45] Date of Patent: Apr. 25, 1989

[54] PROCESS FOR THE ELECTROCHEMICAL SYNTHESIS OF CARBOXYLIC ACIDS

[75] Inventors: Marie-Odile Moingeon, Villabe; Jacques Chaussard, Paris; Michel Troupel, Maincy; Christophe Saboureau, Brie Comte Robert, all of France

[73] Assignee: Societe Nationale Industrielle et Aerospatiale des Poudres et, Paris, France

[21] Appl. No.: 141,492

[22] Filed: Jan. 7, 1988

[30] Foreign Application Priority Data

Jan. 9, 1987 [FR] France ..... 87 00134

[51] Int. Cl.[4] ..... C25B 3/00

[52] U.S. Cl. ..... 204/72; 204/73 R; 204/75; 204/78

[58] Field of Search ..... 204/72, 78, 79, 80, 204/73 R, 74, 75, 76

[56] References Cited

U.S. PATENT DOCUMENTS

| | | | |
|---|---|---|---|
| 4,028,201 | 6/1977 | Tyssee | 204/72 |
| 4,072,583 | 2/1978 | Hallcher et al. | 204/72 |
| 4,708,780 | 11/1987 | Silvestri et al. | 204/72 |

FOREIGN PATENT DOCUMENTS

| | | |
|---|---|---|
| 0189120 | 7/1986 | European Pat. Off. . |
| 2566434 | 9/1986 | France . |

OTHER PUBLICATIONS

*J. Org. Chem.,* vol. 37, No. 12, pp. 1951–1960 (1972), Braqizer et al., Reduction of Organic Halides in the Presence of Electrophiles.

*Primary Examiner*—John F. Niebling
*Assistant Examiner*—Steven P. Marquis
*Attorney, Agent, or Firm*—Burns, Doane, Swecker & Mathis

[57] ABSTRACT

The invention relates to a process for the electrosynthesis of carboxylic acids of general formula R-COOH in which R is an organic radical by the electrochemical reduction, in the presence of carbon dioxide, of organic compounds corresponding to the general formula R—Y in which R is the above-mentioned organic radical and Y is a hetero atom-containing radical, the hetero atom of the radical Y, chosen from the group consisting of oxygen, nitrogen, sulphur andphosphorus, being directly linked to a carbon atom of the radical R by a single covalent linkage. When the hetero atom is nitrogen or phosphorus, the radical Y is an ammonium or phosphonium radical respectively.

The anode, which is consumed during the electrosynthesis, is made of a metal chosen from the group consisting of reducing metals and their alloys, preferably made of magnesium, aluminium or zinc.

This process without catalyst is very simple to perform and enables a cell with a single compartment to be employed.

The carboxylic acids are commonly employed in the chemical industry, especially as intermediates for the synthesis of pharmaceutical products or of products used in plant protection.

17 Claims, No Drawings

PROCESS FOR THE ELECTROCHEMICAL SYNTHESIS OF CARBOXYLIC ACIDS

The present invention relates to a process for the electrosynthesis of carboxylic acids by the electrochemical reduction, in the presence of carbon dioxide, of organic compounds containing at least one single covalent carbonhetero atom linkage, which process is performed in an electrolysis cell in an organic medium.

Carboxylic acids are substances which are commonly employed in the chemical industry, especially as intermediates for the synthesis of pharmaceutical products or of products used in plant protection. There may be mentioned, in particular, their use for the synthesis of penicillins as well as those of anti-inflammatories and of insecticides.

FR No. 2,566,434, of which the Applicant Company is the proprietor, describes the synthesis of carboxylic acids by the electrochemical reduction, in the presence of carbon dioxide, of organic halides. The process is performed in a cell which is preferably not divided into compartments, in an organic medium. The anode, made of magnesium, is consumed during the electrosynthesis by the electrochemical reaction that it is the seat of.

In practice, this process is severely restrained by the toxicity and/or the instability of the starting organic halides as well as the difficulties in obtaining these compounds.

For example, most of the benzyl halides are lacrimators, irritants and corrosives. The most reactive are particularly unstable; para-methoxybenzyl chloride, and chloromethyl- and chloroethyl-thiophenes undergo spontaneous polymerization at ambient temperature with the evolution of a large amount of hydrogen chloride gas. The alpha-arylchloroethanes often undergo dehydrochlorination reactions leading to undesirable styrene derivatives. All these interfering reactions are often accelerated because of the operating conditions for the electrocarboxylation (polar solvents and presence of metal salts). Thus, the electrocarboxylation of para-methoxybenzyl chloride gives para-methoxyphenylacetic acid only with a yield of 50% when the starting material has completely disappeared.

The electrocarboxylation of alpha-chloroethylthiophene gives satisfactory results only at temperatures below −10° C., which is a constraint.

Benzyl halides are difficult to obtain. The most direct method for the synthesis is the chloromethylation of aromatic or aromatic heterocyclic compounds (synthesis of chloromethylthiophene and of chloromethylnaphthalene).

The formation of highly carcinogenic by-products considerably restricts the application thereof.

In general, in almost all cases, the introduction of a halogen into an organic molecule requires the use of a dangerous and corrosive reagent such as hydrochloric acid, hydrobromic acid, thionyl chloride, phosphorus chlorides, chlorine or bromine.

Moreover, in J.O.C. 37,12, 1951–60, 1972, BAIZER obtains benzyl esters or allyl esters by the electrochemical reduction, in the presence of carbon dioxide, of the corresponding benzyl or allyl halides, in an organic medium (dimethylformamide DMF) in the presence of tetraethylammonium chloride as the supporting electrolyte. The cathode is made of mercury and the anode is made of platinum.

Therefore, the allyl or benzyl esters obtained are quite stable against electrocarboxylation because they are isolated with excellent yields.

Moreover, in spite of the large quantities of tetraethylammonium salts present during the electrocarboxylation of organic halides, no acids derived from their carboxylation are formed.

These facts dissuade the person skilled in the art seeking to produce carboxylic acids, from electrocarboxylating quaternary ammonium salts or esters.

The process according to the invention, which goes against this teaching, enables, as compared with the process described in FR No. 2,566,434, all the advantages thereof and especially those mentioned in the application FR No. 2,566,434 itself, to be retained without having the disadvantages thereof and especially those mentioned above, relating to the use of organic halides.

According to the invention, the process for the electrosynthesis of carboxylic acids by the electrochemical reduction, in the presence of carbon dioxide, of organic compounds containing at least one single covalent carbon-hetero atom linkage, which process is performed in an organic medium in an electrolysis cell equipped with electrodes, is characterized in that the anode is made of a metal chosen from the group consisting of reducing metals and their alloys and in that the hetero atom is chosen from the group consisting of oxygen, nitrogen, sulphur and phosphorus.

"Their alloys" means any alloy containing at least one reducing metal.

The reducing metal is preferably chosen from the group consisting of magnesium, aluminium, zinc and their alloys.

The organic compounds containing at least one single covalent carbon-hetero atom linkage which can be employed within the scope of the present invention correspond to the general formula R—Y in which R is an organic radical and Y is a hetero atom-containing radical, the hetero atom chosen from the group consisting of oxygen, nitrogen, sulphur and phosphorus being directly linked to a carbon atom of the organic radical by a single covalent linkage.

Carboxylic acids of general formula R—COOH are so obtained by breaking, in R—Y, of the simple covalent linkage binding the hetero atom of the radical Y to a carbon atom of the radical R and fixation of $CO_2$ on this carbon atom.

During the reaction, an isomerisation of the radical R sometimes occurs. This is the case, for example, when R is an allyl radical.

When the hetero atom is nitrogen, Y is necessarily an ammonium radical

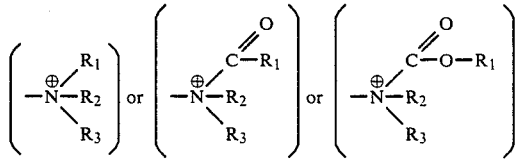

When the hetero atom is phosphorus, Y is necessarily a phosphonium radical

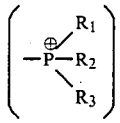

When the hetero atom is oxygen, Y is for example a carboxylate

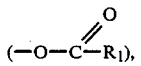

, carbonate

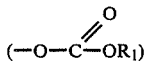

carbamate

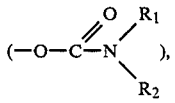

, alkox ($—OR_1$), sulphonate ($—OSO_2R_1$), sulphinate ($—OSOR_1$), sulphate ($OSO_3R_1$), nitrate ($—ONO_2$), phosphate

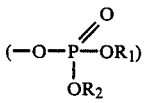

or phosphite

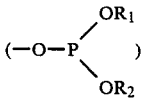

radical.

When the hetero atom is sulphur, Y is for example an alkylthio ($—SR_1$), thiocyanate (—SCN), sulphinyl

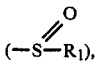

, sulphonyl

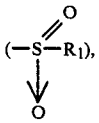

, sulphonium

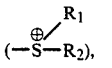

, alkoxysulphinyl

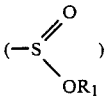

or alkoxysulphonyl

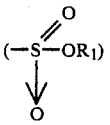

radical.

The radicals $R_1$, $R_2$ and $R_3$ are substituted or unsubstituted aliphatic, aromatic or heterocyclic hydro-carbon radicals. They can also form rings between them or with the radical R.

According to a preferred variant of the invention, unsaturated carboxylic acids are obtained. In this case, the carbon atom of the organic radical R which is directly linked to the hetero atom of the radical Y is "$sp^3$" hybridized (it is sometimes said that such a carbon atom is a "saturated" carbon atom) and at least one of the carbon atoms of the radical R in the beta position relative to the hetero atom of the radical Y is "$sp^2$" hybridized (it is sometimes said that such a carbon atom is an "ethylenically unsaturated" carbon atom). Conventionally and by definition, "$sp^3$" hydridization is a tetrahedral hybridization and "$sp^2$" hybridization is a plane trigonal hybridization.

This "$sp^2$" hybridized carbon atom of the radical R in the beta position relative to the hetero atom is, particularly preferably, an ethylenic carbon atom or a carbon atom which forms part of a substituted or unsubstituted aromatic heterocycle or ring.

When the "$sp^2$" hybridized carbon atom of the radical R in the beta position relative to the hetero atom is an ethylenic carbon atom, the radical R is preferably an aliphatic radical containing 3 to 10 carbon atoms. This is the case for example when R is an allyl radical.

When the "$sp^2$" hybridized carbon atom of the radical R in the beta position relative to the hetero atom forms part of a substituted or unsubstituted aromatic ring, the "$sp^3$" hybridized carbon atom of the radical R which is directly linked to the hetero atom preferably carries either 2 hydrogen atoms or a hydrogen atom and a methyl or ethyl or isopropyl group. In this case, it is particularly preferred that the radical R is a benzyl radical.

When the "$sp^2$" hybridized carbon atom of the radical R in the beta position relative to the hetero atom forms part of a substituted or unsubstituted aromatic heterocycle, this aromatic heterocycle is preferably thiophene, N-methylpyrrole, indole or pyridine.

This is the case for example when R is the radical

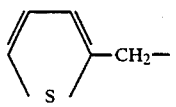

This carbon atom of the raidcal R in the beta position may also be an acetylenic carbon ("$sp^1$" hybridized) or that of a carbonyl or nitrile group.

The organic radical R may contain at least one functional group which cannot be reduced under the conditions of the electrosynthesis. There may be mentioned, for example, carbonyl, nitrile, tertiary amine and amide groups and fluorine.

The abovementioned organic compounds of general formula R—Y are generally readily prepared by conventional methods in organic chemistry. Their synthesis does not present any particular problem, even on an industrial scale.

The anode may have any shape and especially all the conventional shapes for metal electrodes (stranded wie, flat rod, cylindrical rod, rod having a square cross-section, plate, renewable bed, metal cloth, grid, band, beads, shot, powder and the like).

A cylindrical rod having a diameter adapted to the dimensions of the cell is preferably employed.

Before using, it is preferable to clean chemically or mechanically the surface of the anode.

The purity of the metal (or of the alloy) which forms the anode is not a significant parameter and industrial grades are suitable.

The cathode is either any metal such as stainless steel, nickel, platinum, gold, copper or graphite. It preferably consists of a grid or a plate which is cylindrical, arranged concentrically around the anode. For economic reasons, stainless steel is preferably employed.

The electrodes are supplied with direct current using a stabilized power supply.

The organic solvents employed within the scope of this invention are all the solvents which are not very protic, which are commonly employed in organic electrochemistry. There may be mentioned, for example, hexamethylphosphorotriamide (HMPT), tetrahydrofuran (THF), THF-HMPT mixtures, N-methylpyrrolidone (NMP), tetramethylurea (TMU), dimethylformamide (DMF) and acetonitrile.

The supporting electrolytes employed for making the medium conductive or more conductive may be those which are commonly employed in organic electrochemistry. There may be mentioned, for example, tetrabutylammonium tetrafluoroborate ($NBu_4BF_4$), lithium perchlorate ($LiClO_4$), tetrabutylammonium chloride ($NBu_4Cl$), tetraethylammonium chloride ($NEt_4Cl$), tetrabutylammonium perchlorate ($NBu_4ClO_4$ and zinc, magnesium or aluminium salts.

When the supporting electrolyte is an ammonium salt, the latter is at least partially carboxylated according to the invention, however, on the one hand, the quantity of the supporting electrolyte may be low in comparison with the derivative R—Y and, on the other hand, the acid formed by the carboxylation of the electrolyte is readily separated from the acid sought, obtained by the carboxylation of the derivative R—Y.

There is no need to add a supporting electrolyte when the compound R—Y to be reduced itself is ionic, as in the case, for example, of ammonium, sulphonium or phosphonium salts.

When it is necessary to add a supporting electrolyte, its concentration in the organic solvent is preferably between $5\times10^{-3}$ M and $5\times10^{-2}$ M.

Likewise preferably, the concentration of the compound R—Y to be reduced in the organic solvent is between $10^{-1}$ M and 1 M. So this concentration may be relatively high, which is rather uncommon in electrosynthesis. This observation is most certainly very advantageous from an economic point of view.

The electrosynthesis is preferably carried out in a cell which is not divided into compartments:

(1) at a temperature generally between 0° C. and 60° C., preferably between approximately 10° and 30° C., for practical reasons of simplicity;

(2) at an anode current density which may range from $10^{-1}$ to 100 mA/cm$^2$, generally between 10 and 50 mA/cm$^2$. The process is generally carried out at a constant intensity; however, it may also be carried out at constant voltage, at controlled potential or with variable intensity and potential;

(3) in a $CO_2$ atmosphere, the carbon dioxide pressure in the cell being between $10^{-1}$ and 50 bar, preferably at atmospheric pressure for simplicity. In this case, the carbon dioxide is for example bubbled through using a tube sinking into the solution;

(4) the solution being stirred, for example using a magnetic bar.

After electrolysis, the carboxylic acid formed, and possibly the unconverted starting material, are isolated.

The invention is illustrated by the non-limiting examples which follow.

EXAMPLES 1 TO 25

In order to produce these examples, a conventional electrolysis cell, which is not divided into compartments, consisting of 2 parts, is employed.

The upper part, made of glass, is equipped with 5 tubes through which the entry and the exit of carbon dioxide, the electrical connections and the sampling of the solution during the electrolysis if required, are achieved.

The lower part consists of a plug supplied with a seal, screwed onto the upper part made of glass.

The total volume of the cell is 150 cm$^3$.

The anode is a cylindrical rod made of magnesium, the diameter of which is 1 cm. It is introduced into the cell through the central tube and sinks into the solution over a length of approximately 20 cm. The initial working surface area of this electrode is 63 cm$^2$.

The cathode is a cylindrical stainless steel cloth arranged concentrically around the anode.

100 cm$^3$ of dimethylformamide (DMF), 10 g of the compound R—Y to be reduced and 0.5 g of tetrabutylammonium iodide which is added only when the compound R—Y is not ionic so as to make the solution conductive, are introduced into the cell.

$CO_2$ is bubbled through the solution using a tube sinking into this solution. The $CO_2$ pressure is atmospheric pressure.

The solution is stirred with a magnetic bar and the temperature is maintained at approximately 10° C.

The electrodes are supplied with direct current using a stabilized power supply and a constant intensity of 2 A, which amounts to a current density of 32 mA/cm$^2$, is applied to the magnesium anode.

After electrolysis and evaporation of the DMF, the reaction medium is hydrolysed with aqueous hydrochloric acid.

The organic compounds are then extracted with ethyl ether and the acids are then recovered by alkaline extraction.

The products obtained are identified according to conventional analytical methods, viz. especially NMR, IR, GC and mass spectrometry.

The quantity of current employed in each trial and the results obtained are given in the following table:

| EX | COMPOUNDS R—Y | ACIDS OBTAINED | Q | C | $Y_1$ | $Y_2$ |
|---|---|---|---|---|---|---|
| 1 | Benzyl acetate | Phenylacetic acid | 386 | — | — | 76 |
| 2 | Styrallyl acetate | Hydratropic acid | 318 | 80 | 56 | 45 |
| 3 | Para-methoxy-benzyl acetate | Anisylacetic acid | 289 | 30 | 100 | 30 |
| 4 | Para-acetoxy-benzyl acetate | Para-hydroxyphenyl-acetic acid | 193 | — | — | 76 |
| 5 | Para-acetoxystyrallyl acetate | Para-hydroxyphenyl-propionic acid | 386 | — | — | 98 |
| 6 | 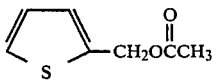 | Thiopheneacetic acid | 395 | — | — | 76 |
| 7 | 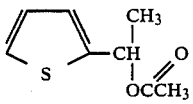 | Thiophenepropionic acid | 318 | — | — | 73 |
| 8 | Cinnamyl acetate | Phenylbutenoic acids | 226 | 95 | 80 | 76 |
| 9 | Benzyl benzoate | Phenylacetic acid | 250 | 85 | 81 | 69 |
| 10 | Phenyl benzyl ether | Phenylacetic acid | 308 | 80 | 61 | 49 |
| 11 | Dibenzyl ether | Phenylacetic acid | 289 | 84 | 69 | 58 |

Q: quantity of current per mole of starting material R—Y (in $10^3$ C)
C: conversion rate (%)
$Y_1$: yield of product isolated relative to the starting material converted (%)
$Y_2$: yield of product isolated relative to the starting material (%)

| EX | COMPOUNDS R—Y | ACIDS OBTAINED | Q | C | $Y_1$ | $Y_2$ |
|---|---|---|---|---|---|---|
| 12 | Styrene oxide | 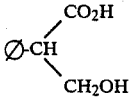 | 72 | — | — | 15 |
| 13 | Dibenzyl carbonate | Phenylacetic acid | 289 | 65 | 62 | 41 |
| 14 | Phenylbenzyl sulphide | Phenylacetic acid | 426 | 95 | 71 | 68 |
| 15 | Benzyl thio-cyanate | Phenylacetic acid | 202 | — | — | 38 |
| 16 | Benzylmethyl sulphide | Phenylacetic acid | 270 | 97 | 38 | 37 |
| 17 | Dibenzyl sulphoxide | Phenylacetic acid | 426 | — | — | 85 |

-continued

| EX | COMPOUNDS R—Y | ACIDS OBTAINED | Q | C | $Y_1$ | $Y_2$ |
|---|---|---|---|---|---|---|
| 18 | Dibenzyl sulphone | Phenylacetic acid | 386 | — | — | 62 |
| 19 | Diphenyl sulphone | Benzoic acid | 212 | 100 | 95 | 95 |
| 20 | Benzyltriphenyl-phosphonium chloride | Phenylacetic acid | 386 | 60 | 50 | 30 |
| 21 | Benzyltrimethyl-ammonium chloride | Phenylacetic acid | 318 | — | — | 47 |
| 22 | Benzyltributyl-ammonium chloride | Phenylacetic acid | 299 | — | — | 90 |

Q: quantity of current per mole of starting material R—Y (in $10^3$ C)
C: conversion rate (%)
$Y_1$: yield of product isolated relative to the starting material converted (%)
$Y_2$: yield of product isolated relative to the starting material (%)

| EX | COMPOUNDS R—Y | ACIDS OBTAINED | Q | C | $Y_1$ | $Y_1$ |
|---|---|---|---|---|---|---|
| 23 | Para-methoxy-benzyldimethyl-ethylammonium chloride | Anisylacetic acid | 560 | — | — | 79 |
| 24 | 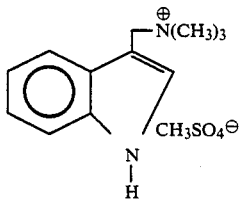 | Indolylacetic acid | 289 | — | — | 14 |

-continued

| EX | COMPOUNDS R—Y | ACIDS OBTAINED | Q | C | $Y_1$ | $Y_1$ |
|---|---|---|---|---|---|---|
| 25 | 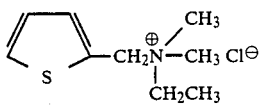 | Thiopheneacetic acid | 482 | — | — | 65 |

Q: quantity of current per mole of starting material R—Y (in $10^3$ C)
C: conversion rate (%)
$Y_1$: yield of product isolated relative to the starting material converted (%)
$Y_2$: yield of product isolated relative to the starting material (%)

EXAMPLE 26

The electrolysis of para-methoxybenzylethyldimethylammonium chloride is carried out under the same conditions as in Example No. 23, but in a stainless steel cell at a $CO_2$ pressure of 5 bars and at a temperature of 30° C.

After an electrolysis corresponding to the passage of $2.7\times10^5$ C per mole of ammonium salt, anisylacetic acid is isolated with a yield of 73%.

EXAMPLE 27

The electroysis of benzyltributylammonium chloride ($2.4\times10^5$ C per mole of ammonium salt) under the conditions of Example 26 enables phenylacetic acid to be isolated with a yield of 83%.

EXAMPLE 28

The electrolysis of dibenzyl ether ($3.4\times10^5$ C/mole of dibenzyl ether), under the same conditions as those in Example 11, but replacing the dimethylformamide with acetonitrile and the magnesium anode by an aluminium anode having the same dimensions, makes it possible to obtain a dibenzyl ether conversion rate of 54% and a yield of phenylacetic acid isolated of 90% relative to the dibenzyl ether converted.

EXAMPLE 29

A dimethylbenzylacetylammonium chloride solution is prepared by adding, at +5° C., 9 g of acetyl chloride to a solution of 15 g of dimethylbenzylamine in 110 g of DMF. The electrolysis of this solution in the device described in Example 1, at +5° C., and at a current of intensity 2 A, gives, after passing $2.3\times10^5$ C per mole of dimethylbenzylacetylammonium chloride, phenylcetic acid which is isolated with a yield of 15%.

We claim:

1. Process for the electrosynthesis of carboxylic acids of the general formul R—COOH, in which R is an organic radical, comprising: electrochemically reducing, in the presence of carbon dioxide, an organic compound of the general formula R—Y, in which R is said organic radical and Y is a hetero atom-containing radical, said hetero atom being directly linked to a carbon atom of said radical R by a single covalent linkage and being selected from the group consisting of oxygen, nitrogen, sulphur, and phosphorus, wherein said process is performed in an organic medium in an electrolysis cell that includes an anode made of a metal chosen from the group consisting of reducing metals and alloys thereof, and wherein if said hetero atom is nitrogen, said radical Y is an ammonium radical, and if said hetero atom is phosphorus, said radical Y is a phosphonium radical.

2. Process according to claim 1, wherein the anode is made of a metal chosen from the group consisting of magnesium, aluminium, zinc and their alloys.

3. Process according to claim 1, wherein the hetero atom-containing radical Y is chosen from the group consisting of carboxylate, carbonate, carbamate, alkoxy, sulphonate, sulphinate, sulphate, nitrate, phosphate, phosphite, alkylthio,thiocyanate, sulphinyl, sulphonyl, alkoxysulphinyl, alkoxysulphonyl and sulphonium radicals.

4. Process according to claim 1 wherein said carbon atom of the organic radical R which is directly linked to the hetero atom of the radical Y is "$sp^3$" hybridized and at least one of the carbon atoms of the radical R in the beta position relative to said hetero atom is "$sp^2$" hybridized.

5. Process according to claim 4 wherein the "$sp^2$" hybridized carbon atom of the radical R in the beta position relative to the hetero atom of the radical Y is an ethylenic carbon atom or a carbon atom which forms part of a substituted or unsubstituted aromatic heterocycle or ring.

6. Process according to claim 4, wherein the "$sp^2$" hybridized carbon atom of the radical R in the beta position relative to the hetero atom of the radical Y is an ethylenic carbon atom and in that the radical R is an aliphatic radical containing 3 to 10 carbon atoms.

7. Process according to claim 4, wherein the "$sp^2$" hybridized carbon atom of the radical R in the beta position relative to the hetero atom forms part of a substituted or unsubstituted aromatic ring and in that the "$sp^3$" hybridized carbon atom of the radical R which is directly linked to the hetero atom carries either 2 hydrogen atoms or a hydrogen atom and a methyl or ethyl or isopropyl group.

8. Process according to claim 7, wherein the radical R is a benzyl radical.

9. Process according to claim 4, wherein the "$sp^2$" hybridized carbon atom of the radical R in the beta position relative to the hetero atom forms part of an aromatic heterocycle chosen from the group consisting of thiophene, N-methylpyrrole, indole and pyridine.

10. Electrosynthesis process according to claim 1, wherein said organic medium is selected from the group consisting of hexamethylphosphorotriamide (HMPT), tetrahydrofuran (THF), THF-HMPT mixtures, N-methylpyrrolidone (NMP), tetramethylurea (TMU), dimethylformamide (DMF) and acetonitrile is employed.

11. Process according to claim 1, wherein said process is performed in the presence of a supporting electrolyte to make the medium conductive or more conductive.

12. Process according to claim 11, wherein the concentration of the supporting electrolyte is between $5\times10^{-1}$ M and $5\times10^{-2}$ M.

13. Process according to claim 1, wherein the concentration, in said organic medium of the organic compounds corresponding to the general formula R—Y is between $10^{-1}$ M and 1 M.

14. Process according to claim 1, wherein the electrosynthesis is carried out at a temperature of between 10° and 30° C.

15. Process according to claim 1, wherein the carbon dioxide pressure is atmospheric pressure.

16. Process according to claim 1, wherein the electrosynthesis is carried out at a constant intensity.

17. Process according to claim 1, wherein the cathode is made of stainless steel.

* * * * *